US006220069B1

(12) United States Patent
Wehmeyer et al.

(10) Patent No.: US 6,220,069 B1
(45) Date of Patent: Apr. 24, 2001

(54) METHOD AND APPARATUS FOR BENDING TUBING

(75) Inventors: John E. Wehmeyer, Centerville; James K. Klingensmith, Wilmington, both of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/487,855

(22) Filed: Jan. 19, 2000

(51) Int. Cl.[7] ..... B21D 7/04
(52) U.S. Cl. ..... 72/149; 72/159
(58) Field of Search ..... 72/149, 157, 158, 72/159

(56) References Cited

U.S. PATENT DOCUMENTS 4,038,853 * 8/1977 Schwarze ..... 72/157
4,078,411 * 3/1978 Eaton ..... 72/154
4,083,216 * 4/1978 Gilkerson et al. ..... 72/149
4,178,788 * 12/1979 Zollweg et al. ..... 72/159
4,236,398 * 12/1980 Schwrze ..... 72/157
4,899,567 * 2/1990 Lenglet et al. ..... 72/159

* cited by examiner

*Primary Examiner*—Rodney A. Butler
(74) *Attorney, Agent, or Firm*—Andrew C. Hess; Gerry S. Gressel

(57) ABSTRACT

A bend die assembly includes a bend die and a clamp block assembly. The bend die is reversible and includes a T-shaped projection which extends outward from the bend die. The clamp block assembly includes a first clamp block and a mating second clamp block. The first clamp block includes a first T-shaped opening sized to slidably receive the bend die T-shaped projection. Each clamp block includes a tube groove which includes a plurality of indentations corresponding to a desired compound bend to be formed in tubing.

20 Claims, 2 Drawing Sheets

METHOD AND APPARATUS FOR BENDING TUBING

BACKGROUND OF THE INVENTION

This invention relates to bend dies, and more particularly, to bend dies which produce multiple bends within tubing.

Tubing often is used to carry pressurized fluids from one location to another. The tubing is installed after assembly of major components and must be routed around obstructions to complete a fluid circuit. Such routing may require compound bends in the tubing.

Typically, compound bends are formed using manual or automated bending machines. To form compound bends, the tubing often must be located in multiple pre-bending tubing positions to securely position the tubing while the tubing is bent. Multiple clamps are used to hold the tubing in place. However, a straight section of tubing between clamps typically is required to form the desired bends. The straight section length is typically a minimum of two to three times a diameter of the tubing.

To form a compound bend having bends closer together than possible with known manual or automated bending machines, a portion of the desired bends is formed on several pieces of tubing. The separate pieces are then welded together to form a single tube having the desired compound bends. Alternatively, a first portion of the compound bend is formed using a bending machine and a first clamp block, and a second clamp block is manufactured to include a second portion of the desired compound bend and used with the bending machine to form a second portion of the compound bend. The process is repeated with as many clamp blocks as necessary until the desired compound bend is formed in a single piece of tubing.

Welding multiple sections of tubing together to form a single tubing having the desired compound bends, produces tubing that does not have the structural integrity of non-welded tubing. Creating a compound bend using multiple clamp blocks forms a compound bend in tubing that maintains the structural integrity of non-welded tubing, but is much more laborious and cumbersome to form. Multiple assembly set-ups and clamp block manufacturing increases the time necessary to form a desired compound bend in tubing.

BRIEF SUMMARY OF THE INVENTION

In an exemplary embodiment, a bend die assembly facilitates the formation of a compound bend in a single tube in a single operation. The assembly includes a bend die, a base, and a clamp block assembly. The bend die is attached to the base and includes a t-shaped projection which extends outward from the bend die. The clamp block assembly includes a first clamp block and a second clamp block. The first clamp block includes a first opening, a plurality of second openings, and a plurality of projections. The first opening is substantially T-shaped and slidably receives the bend die projection. The plurality of second openings are disposed in a bottom surface of the first clamp block and engage a plurality of clamp block drive keys attached to the base. The first clamp block also includes a tube groove which includes a plurality of indentations which in combination with the second clamp block produce a desired compound bend in tubing.

In operation, the first clamp block is easily installed or removed from the bend die. Additionally, the first clamp block and the second clamp block each include a tube groove which mate together to hold and position the tube as the bend die forms the desired compound bend in one operation. Because all bending is accomplished with the use of the bend die and the clamp block assembly, no pre-bend setup steps are necessary. Furthermore, because no additional clamps are used to position the tubing, a straight length of tubing is not necessary between bends in the compound bend.

DETAILED DESCRIPTION OF THE INVENTION

Figure 1:
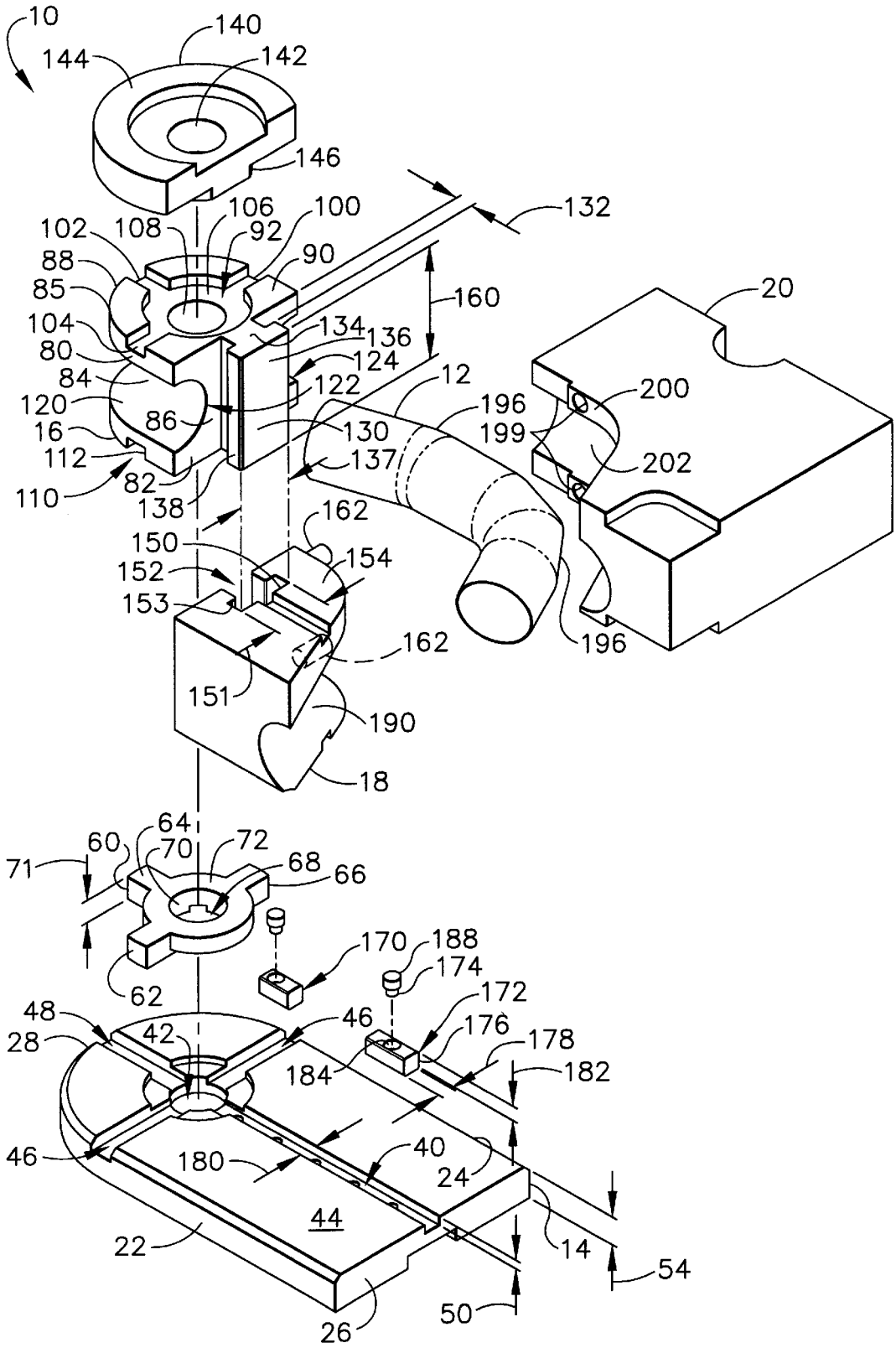
FIG. 1 is an exploded top perspective view of a bend die assembly.

FIG. 1 is an exploded top perspective view of a bend die assembly 10 for use with a bending machine (not shown) in bending tubing 12. Bend die assembly 10 includes a base 14, a bend die 16, a first clamp block 18, and a second clamp block 20. Base 14 includes a first side 22, and a second side 24 attached to first side 22 with a third side 26 and a fourth side 28. A first groove 40 extends from third side 26 towards fourth side 28 to a center opening 42. Center opening 42 extends from a base top surface 44 to a base bottom surface (not shown in FIG. 1). A second groove 46 extends from first side 22 through center opening 42 to second side 24. A third groove 48 extends from fourth side 28 to center opening 42. Grooves 40, 46, and 48 have a depth 50 which extends from base top surface 44 towards the base bottom surface. Depth 50 is less than a thickness 54 of base 14.

Grooves 40, 46, and 48 are sized to receive a bend die locator 60 when bend die assembly 10 is fully assembled. Bend die locator 60 is positioned between base 14 and bend die 16 and includes a first leg 62, a second leg 64, and a third leg 66, each extending radially outward from a center ring 68. Ring 68 includes an opening 70 which is positioned substantially concentrically with base center opening 42. Bend die locator 60 has a thickness 71 extending between a locator top surface 72 and a locator bottom surface (not shown) which is uniform throughout bend die locator 60. Thickness 71 is greater than depth 50 and as such, when bend die locator 60 is attached to base 14, top surface 72 extends from base top surface 44 and engages bend die 16.

Bend die 16 includes a top portion 80, a bottom portion 82, a body portion 84 extending between top portion 80 and bottom portion 82, and a top outer edge 85. Bend die 16 also includes a front wall 86 and a rear wall 88. Rear wall 88 extends from front wall 86 such that top portion 80 and bottom portion 82 have planar semi-circular cross sectional profiles (not shown).

Top portion 80 includes a top surface 90 and a keyway 92. Top surface 90 extends between front wall 86 and rear wall 88. Keyway 92 includes a first groove 100, a second groove 102, and a third groove 104. Grooves 100, 102, and 104 extend radially outward from an annular shoulder 106 to top outer edge 85 of bend die 16. Additionally, grooves 100, 102, and 104 are sized to receive bend die locator legs 62, 64, and 66. Annular shoulder 106 extends circumferentially from a center opening 108. Center opening 108 extends through bend die 16 from top portion top surface 90 through body portion 84 and through bottom portion 82.

Bend die bottom portion 82 is constructed substantially identically to bend die top portion 80 and includes a keyway 110 constructed identically to keyway 92. Keyway 110 includes a first groove 112, a second groove (not shown in FIG. 1), and a third groove (not shown in FIG. 1) extending radially outward from center opening 108 through a bottom surface (not shown in FIG. 1) of bend die 16. Keyways 110 and 92 are sized such that when bend die 16 is attached to bend die locator 60, bend die locator legs 62, 64, and 66 are received in keyway 92 or 110. Legs 62, 64, and 66 ensure bend die 16 is aligned and during a bending operation, legs 62, 64, and 66 transfer loading induced into bend die 16 from the bending machine into base 14. In one embodiment, when bend die 16 is attached to bend die locator 60, bend die bottom portion keyway 110 engages legs 62, 64, and 66. Alternatively, bend die 16 is attached to bend die locator 60 such that bend die top portion keyway 92 engages legs 62, 64, and 66.

Body portion 84 includes a tube groove 120 circumscribing bend die top outer edge 85 along rear wall 88. Tube groove 120 is substantially semi-circular and is sized to receive tubing 12. Tube groove 120 extends approximately 180 degrees along rear wall 88 to front wall 86 such that adjacent front wall 86, a first side 122 of tube grove 120 is substantially parallel to a second side 124 of tube groove 120.

A projection 130 extends outward from bend die front wall 86 a distance 132. Projection 130 is substantially T-shaped and has a first portion 134 and a second portion 136 extending from first portion 134. Second portion 136 has a width 137 extending from a first side wall 138 to a second side wall (not shown in FIG. 1). Projection 130 is positioned between tube groove first side 122 and tube groove second side 124. Additionally, projection 130 is continuous and extends from the bend die bottom surface to bend die top surface 90.

A locator cap 140 is attached to bend die 16. During a bending operation, locator cap 140 rotates simultaneously with bend die 16 and indicates an amount of bending that has been applied to tubing 12. Locator cap 140 includes a center opening 142, a top surface 144, and a bottom surface (not shown in FIG. 1). When locator cap 140 is attached to bend die 16, center-opening 142 is substantially concentric with center opening 108 such that when bend die assembly 10 is fully assembled, a bolt (not shown) extends through openings 42, 70, 108, and 142 and is secured with a nut (not shown) which secures bend die assembly 10 together.

A projection 146 extends from the bottom surface of locator cap 140. Projection 146 engages keyway annular shoulder 106 when locator cap 140 is attached to bend die 16. In one embodiment, locator cap 140 is attached to bend die 16 such that the bottom surface of locator cap 140 contacts bend die top surface 90. Alternatively, depending on the installation of bend die 16, locator cap 140 may be installed such that the bottom surface of locator cap 140 contacts bend die bottom surface.

First clamp block 18 includes an opening 150 which has a width 151. Opening 150 is substantially T-shaped and includes a first opening portion 152 and a second opening portion 153. Second opening portion 153 has a width approximately equal to width 137 of bend die projection second portion 136. As such, opening 150 is sized to slidably receive bend die projection 130 to create an interfit (not shown) between projection 130 and opening 150. The interfit connection secures first clamp block 18 to bend die 16 such that during a bending operation, first clamp block 18 cannot rotate independently of bend die 16. Additionally, the interfit permits clamp block 18 to be easily removed from bend die 16 when a different clamp block (not shown) is being installed.

Opening 150 is disposed within a front surface (not shown in FIG. 1) of first clamp block 18 and extends from a top surface 154 of first clamp block 18 to a bottom surface (not shown in FIG. 1) of first clamp block 18. A distance (not shown in FIG. 1) between top surface 154 and the bottom surface of first clamp block 18 is substantially equal to a distance 160 extending between bend die top surface 90 and the bend die bottom surface. First clamp block 18 also includes a plurality of guide pins 162 and a channel opening (not shown in FIG. 1). Guide pins 162 extend outward from a first side (not shown in FIG. 1) of first clamp block 18 and during a bending operation, engage second clamp block 20. The channel opening is disposed in the bottom surface of first clamp block 18 and are sized to receive a pair of clamp block drive keys 170 and 172.

Clamp block drive keys 170 and 172 are constructed identically and each includes a screw 174 and a channel block 176. Each channel block 176 has a width 178 approximately equal to a width 180 of base first groove 40. Additionally, each channel block has a thickness 182 larger than first groove depth 50. As such, each channel block 176 is slidably received in first groove 40. Furthermore, each channel block 176 includes an opening 184 sized to receive screw 174 which secures channel block 176 in place on bend die assembly base 14. Channel block 176 is counterbored such that when screw 174 is fully inserted within channel block 176, a head portion 188 is fully inserted within channel block 176. When first clamp block 18 is attached to bend die 16, channel block 176 engages the openings disposed in the bottom surface of first clamp block 18. During a bending operation, the combination of the interfit between first clamp block 18 and bend die 16 and the interaction between channel blocks 176 and clamp block 18, transfers loads induced by the bending machine into bend die assembly base 14.

First clamp block 18 also includes a tube groove 190. Tube groove 190 is semi-circular in shape and is positioned such that when first clamp block 18 is fully attached to bend die 16, a first end (not shown) of tube groove 190 adjacent top surface 154 is substantially co-planar and aligned with bend die tube groove 120. In one embodiment, the first end of tube groove 190 is aligned with second side 124 of tube groove 120. Alternatively, depending on the installation of bend die 16, the first end of tube groove 190 is aligned with first side 122 of bend die tube groove 120. Tube groove 190 includes a plurality of indentations (not shown) which engage tubing 12 during a bending operation.

Second clamp block 20 is attached to the bending machine. A plurality of openings 199 are disposed in a side wall 200 of second clamp block 20 and are sized to receive a plurality of guide pins 162 extending from first clamp block 18. Side wall 200 also includes a tube groove 202 semi-circular in shape and shaped to align and mate with tube groove 190 of first clamp block 18. As such, tube groove 202 includes a plurality of indentations (not shown in FIG. 1), which correspond to the indentations within tube groove 190.

In operation, base 14 is positioned in close proximity to the bending machine and bend die locator 60 is attached to base 14 such that bend die locator legs 62, 64, and 66 engage base grooves 40, 46, and 48. Bend die 16 is attached to bend die locator 60 such that either bend die top surface 90 or the bend die bottom surface is in contact with bend die locator 60. Locator cap 140 is attached to bend die 16 and a first clamp block, i.e. 18, and a mating second clamp block, i.e. 20, are selected which include the tube groove indentations which will engage desired bends 196 in tubing 12. Clamp block drive keys 170 and 172 are installed within base groove 40 and the first clamp block is slidably attached to bend die 16 such that an interfit is created between bend die T-shaped projection 130 and the corresponding T-shaped opening, i.e., 150 of the first clamp block, and such that the first clamp block engages clamp block drive keys 170 and 172. Tubing 12 is positioned within bend die tube groove 120 and within a tube groove, i.e. 190, disposed within the first clamp block selected. The mating second clamp block is attached to the bending machine, and during operation is forced against tubing 12 to secure tubing 12 between the clamp blocks selected such that the bending machine may produce bends 196 within tubing 12 with bend die 16.

Figure 2:
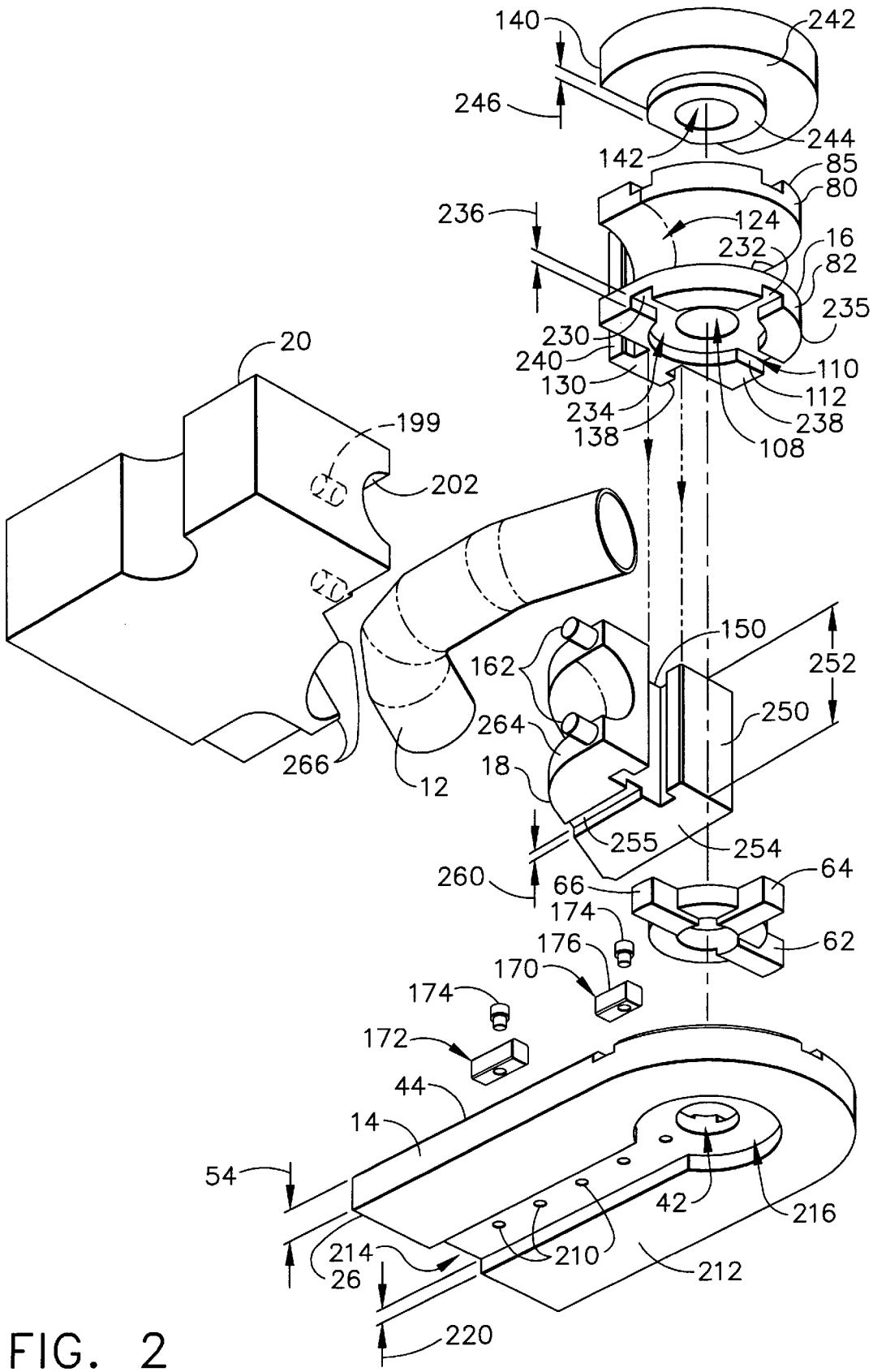
FIG. 2 is an exploded bottom perspective view of the bend die assembly shown in FIG. 1.

FIG. 2 is an exploded bottom perspective view of bend die assembly 10 including base 14, bend die 16, first clamp block 18, and second clamp block 20. Base 14 includes center opening 42 and a plurality of openings 210. Center opening 42 extends from base top surface 44 to a base bottom surface 212 and is sized to receive a bolt used to secure bend die 16 and locator cap 140 to base 14. Openings 210 are disposed within base first groove 40 (shown in FIG. 1) and extend from base top surface 44 to base bottom surface 212. Openings 210 are sized to receive clamp block drive key screws 174 to secure clamp block drive keys 170 and 172 to base 14. Base bottom surface 212 includes a groove 214 which extends from base third side 26 to an indentation 216. Indentation 216 circumferentially surrounds center opening 42 and has a depth 220 which is less than base thickness 54 and is uniform throughout groove 214 and indentation 216. Groove 214 and indentation 216 are sized to mount to a bending machine (not shown).

Bend die 16 includes bottom portion 82, top portion 80 (shown in FIG. 1), and projection 130. Bottom portion 82 is constructed substantially identically to top portion 80 and includes keyway 110. Keyway 110 includes first groove 112, a second groove 230, and a third groove 232. Grooves 112, 230, and 232 extend radially outward from an annular shoulder 234 to a bottom outer edge 235 of bend die 16. Additionally, grooves 112, 230, and 232 are sized to receive bend die locator legs 62, 64, and 66. Annular shoulder 234 extends circumferentially from center opening 108 and has a depth 236 extending inward from a bottom surface 238. Bend die projection 130 extends outward from bend die front wall 86 (shown in FIG. 1) and includes first side wall 138 and a second side wall 240. Projection 130 is positioned between tube groove first side 122 (shown in FIG. 1) and tube groove second side 124.

Locator cap 140 includes center opening 142, top surface 144 (shown in FIG. 1), and a bottom surface 242. Bottom surface 242 includes a projection 244 which circumferentially surrounds center opening 142 and extends from bottom surface 242 a distance 246. Projection 244 is sized to fit within bend die keyway 92 (shown in FIG. 1) or bend die keyway 110 when locator cap 140 is attached to bend die 16.

First clamp block 18 includes opening 150 sized to receive bend die projection 130 and is disposed within a front surface 250 of first clamp block 18. First clamp block top surface 154 (shown in FIG. 1) is a distance 252 from a first clamp block bottom surface 254. Distance 252 is substantially equal to a distance 160 (shown in FIG. 1) extending between bend die top surface 90 (shown in FIG. 1) and bend die bottom surface 238. First clamp block 18 also includes guide pins 162 and a channel opening 255. Channel opening 255 extends a distance 260 inward from first clamp block bottom surface 254 and is sized to receive clamp block drive keys 170 and 172. Guide pins 162 extend from a first side 264 of first clamp block 18 and during a bending operation engage second clamp block 20.

Second clamp block 20 includes openings 199 sized to receive guide pins 162. Additionally, second clamp block 20 includes tube groove 202. Tube groove 202 is sized to receive tubing 12 and includes a plurality of indentations 266 which correspond to indentations (not shown) within first clamp block tube groove 190.

The above-described bend die assembly is cost-effective and highly reliable. The bend die assembly is easily assembled and includes components which are reversible and increase the option available to a user. The components are slidably attached and are quickly interchanged. As a result, a bend die assembly is provided which permits the formation of a compound bend in a single tube in a single operation. Thus, a structurally sound tube is produced without a laborious and time-consuming operation.

While the invention has been described in terms of various specific embodiments, those skilled in the art will recognize that the invention can be practiced with modification within the spirit and scope of the claims.

What is claimed is:

1. An assembly for bending tubing comprising;

a base;

a bend die attached to said base, wherein the bend die includes a tube groove having a non-linear portion, a first clamp block, wherein the first clamp block includes a tube groove having a non-linear portion, and wherein the first clamp block is slidably attached to the bend die to align the tube groove of the first clamp block with the tube groove of the bend die, and a second clamp block, wherein the second clamp block includes a tube groove having a non-linear portion, and wherein the second clamp block is movable with respect to the first clamp block.

2. An assembly in accordance with claim 1 further comprising a bend die locator attached to said base between said base and said bend die, said bend die locator configured to transfer force from said bend die to said base.

3. An assembly in accordance with claim 1 wherein the tube groove of the first clamp block is shaped to accommodate the inside portion of a tube bend, and wherein tube groove of the second tube clamp is shaped to accommodate the outside portion of the tube bend.

4. An assembly in accordance with claim 2 wherein said bend die further comprises a top surface and a bottom surface, said bend die attached to said base such that said top surface is adjacent said base.

5. An assembly in accordance with claim 2 wherein said bend die further comprises a top surface and a bottom surface, said bend die attached to said base such that said bottom surface is adjacent said base.

6. An assembly in accordance with claim 3 wherein said first clamp block comprises a plurality of projections configured to engage said second clamp block.

7. An assembly in accordance with claim 6 wherein said second clamp block comprises a plurality of openings sized to receive said first clamp block plurality of projections.

8. An assembly in accordance with claim 7 further comprising a bend die locator attached to said base between said base and said bend die, said bend die locator configured to transfer induced pressures from said bend die to said base.

9. An assembly in accordance with claim 8 further comprising a locator cap and a plurality of clamp block drive keys, said locator cap attached to said bend die, said clamp block drive keys attached to said base between said base and said first clamp block.

10. A method for bending tubing, the method comprising the steps of:

providing a bend die assembly comprising a base, a bend die, and a first clamp block, wherein the bend die includes a tube groove having a non-linear portion, and wherein the first clamp block includes a tube groove having a non-linear portion;

attaching the bend die to the base;

slidably attaching the first clamp block to the bend die wherein the tube groove of the first clamp block is aligned with the tube groove of the bend die;

positioning a tube with respect to the bend die and first clamp block; and bending the tubing.

11. A method in accordance with claim 10 further comprising the step of providing a second clamp block for clamping the tube in association with the first clamp block, wherein the second clamp block includes a tube groove having a non-linear portion.

12. A method in accordance with claim 11 wherein the bend die includes a top surface and a bottom surface, said step of attaching the bend die to the base further comprising the step of attaching the bend die to the base such that the bend die bottom surface is adjacent the base.

13. A method in accordance with claim 11 wherein the bend die includes a top surface and a bottom surface, said step of attaching the bend die to the base further comprising the step of attaching the bend die to the base such that the bend die top surface is adjacent the base.

14. A method in accordance with claim 12 wherein the bend die assembly further includes a plurality of clamp block drive keys mounted to the base between the base and the first clamp block, and wherein the method comprises slidably attaching the first clamp block to the bend die and engaging the clamp block drive keys with the first clamp block.

15. A bend die assembly configured for use with a bending machine, said bend die assembly comprising:

a base;

a bend die attached to said base wherein the bend die includes a tube groove having a non-linear portion; and a first clamp block slidably attached to said bend die, wherein the first clamp block includes a tube groove having a non-linear portion aligned with a non-linear portion of the tube groove in the bend die.

16. A bend die assembly in accordance with claim 15 further comprising a second clamp block movable with respect to the first clamp block, and the second clamp block comprising a tube groove having a nonlinear portion.

17. A bend die assembly in accordance with claim 16 wherein the tube groove of the first clamp block is shaped to accommodate the inside portion of a tube bend, and wherein tube groove of the second tube clamp is shaped to accommodate the outside portion of the tube bend.

18. A bend die assembly in accordance with claim 17 wherein said bend die further comprises a top surface and a bottom surface, said bend die attached to said base such that at least one of said top surface and said bottom surface is adjacent said base.

19. A bend die assembly in accordance with claim 18 further comprising a bend die locator attached to said base between said base and said bend die.

20. A bend die assembly in accordance with claim 19 further comprising a locator cap and a plurality of clamp block drive keys, said locator cap attached to said bend die, said clamp block drive keys attached to said base between said base and said first clamp block.

* * * * *